US005511878A

United States Patent [19]

Dedoes et al.

[11] Patent Number: 5,511,878

[45] Date of Patent: Apr. 30, 1996

[54] DRIVE MEMBER FOR AUTOMATIC PAINT STIRRING EQUIPMENT

[75] Inventors: John T. Dedoes, Brighton; Richard Powers, Ferndale, both of Mich.

[73] Assignee: Dedoes Industries, Inc., Walled Lake, Mich.

[21] Appl. No.: 425,397

[22] Filed: Apr. 20, 1995

[51] Int. Cl.[6] ..... B01F 7/20

[52] U.S. Cl. ..... 366/198; 366/331; 366/605; 403/233; 403/326

[58] Field of Search ..... 366/197, 198, 366/241–252, 331, 605; 403/233, 256, 326

[56] References Cited

U.S. PATENT DOCUMENTS

| | | | |
|---|---|---|---|
| 2,603,461 | 7/1952 | Marienthal | 366/605 X |
| 2,802,649 | 8/1957 | Stockton | 366/197 |
| 2,832,943 | 4/1958 | Cutler | 403/326 X |
| 2,965,363 | 12/1960 | Worden | 366/197 |
| 3,118,653 | 1/1964 | Dedoes | 366/251 X |
| 3,175,808 | 3/1965 | Dedoes | 366/247 X |
| 3,476,421 | 11/1969 | Torres | 403/326 X |
| 5,160,198 | 11/1992 | Fillon | 366/198 |

FOREIGN PATENT DOCUMENTS

| | | | |
|---|---|---|---|
| 2203059 | 10/1988 | United Kingdom | 366/605 |

*Primary Examiner*—Charles E. Cooley
*Attorney, Agent, or Firm*—Gifford, Krass, Groh, Sprinkle, Patmore, Anderson & Citkowski

[57] ABSTRACT

An improved drive mechanism is provided for use with automatic paint stirring equipment of the type having a rack adapted to removably receive and support paint cans wherein each paint can has a cover, a stirring element contained within the can and a driven member positioned above the cover and mechanically connected to the stirring element. The improved drive mechanism includes a drive shaft having a diametric cross bore at a position spaced from the first end of the shaft. A diametrically extending opening extends from the cross bore to the first end of the shaft and this opening has a smaller cross-sectional area than the shaft cross bore. The shaft is rotatably mounted to the rack so that the first end of the shaft is positioned adjacent the driven member on the paint can. A drive member is then secured to the first end of the shaft which drivingly engages the driven member on the paint can during rotation of the shaft. This drive member has an axle and a drive plate secured to the axle. Additionally, the axle includes a diametrically extending through slot dimensioned so that, upon inward compression of the axle causing reduction in the size of the size of the slot, the axle has a cross-sectional shape smaller than the shaft opening so that the axle is slidable through the shaft opening and to the shaft cross bore. With the axle positioned in the crossbore, the slot expands such that the axle has a cross-sectional shape greater than the shaft opening thereby securing the axle to the shaft.

7 Claims, 2 Drawing Sheets

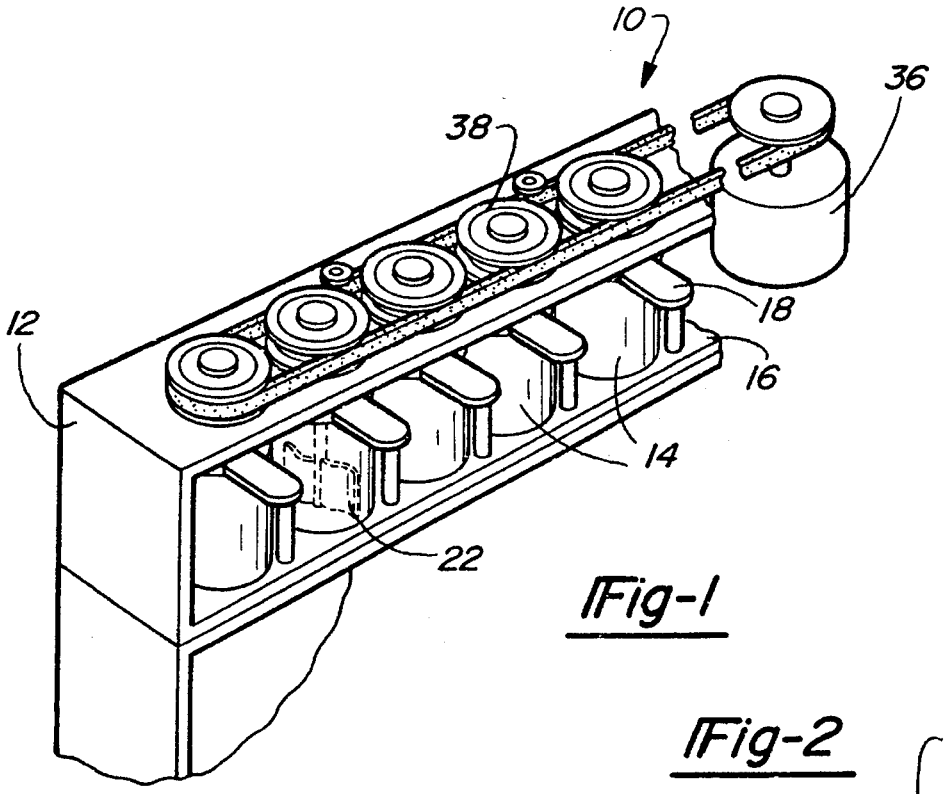
Fig-1
Fig-2
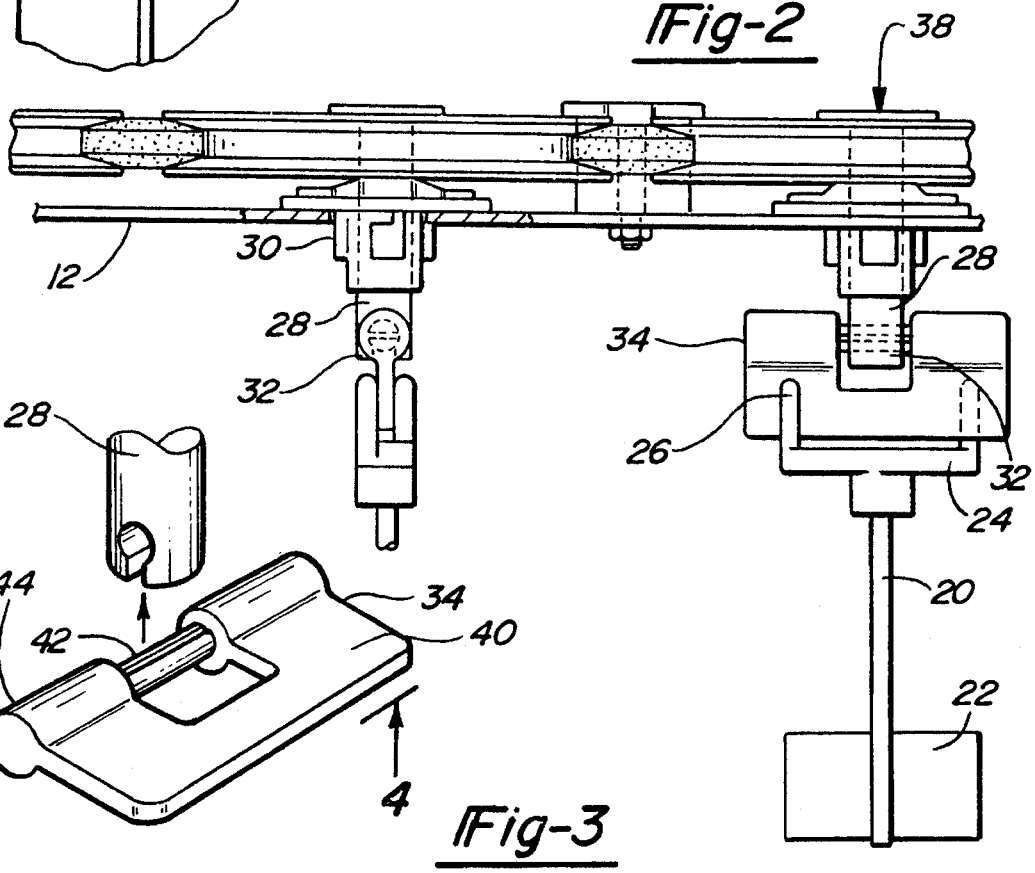
Fig-3
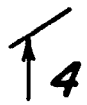

DRIVE MEMBER FOR AUTOMATIC PAINT STIRRING EQUIPMENT

BACKGROUND OF THE INVENTION

I. Field of the Invention

The present invention relates generally to automatic paint stirring equipment and, more particularly, to an improved drive member for such equipment.

II. Description of the Prior Art

The automatic paint stirring equipment of the type commonly found in automotive paint shops typically comprise a rack adapted to removably receive and support paint cans. The paint cans, furthermore, include a cover which extends across the top of the paint can. A stirring element is rotatably mounted to the paint can cover. This stirring element typically includes a paddle contained within the interior of the can as well as a driven member positioned above the paint can cover.

The paint can racks are designed to removably receive and support the paint cans once they are positioned in the rack. In some cases, horizontally extending shelves are provided across the rack for supporting the bottoms of the paint cans. In other cases, different support mechanisms are provided for slidably receiving the paint can covers so that the paint cans are supported by the cover.

In either case, once the paint can is positioned within the rack, the driven element of the stirring assembly is mechanically coupled with a driven member mounted to the rack. This driven member, furthermore, is rotatably driven by a motor contained within the rack so that rotation of the drive member rotatably drives the driven member and thus the stirring paddle contained within the paint can.

One type of previously known drive mechanism for the rack comprised a shaft rotatably mounted to the rack so that a first end of the shaft was positioned adjacent the driven member of the paint can once the paint can was positioned within the rack. The other or second end of the drive shaft was connected to a motor via a pulley assembly. The previously known driven members of the paint can covers typically comprise a pair of upwardly extending and radially spaced ears which are in turn connected to the stirring paddle by a shaft. A generally rectangular plate is then secured by a pin to the first or lower end of the drive shaft so that the plate is positioned in between the upwardly extending ears of the driven member. Consequently, upon rotation of the drive member, the plate engages the ears on the driven member and rotatably drives the driven member in unison with the drive member.

The attachment of these previously known drive members to the drive shaft, however, has previously been not only difficult, but also labor intensive. Typically, the drive plate includes a through bore along one edge which is aligned with a cross bore in the drive shaft. A drive pin is then driven through the drive plate cross bore and shaft cross bore thus attaching the drive member to the drive shaft. Such an operation is not only difficult to achieve, but also labor intensive. Still other methods for attaching the drive member to the drive shaft are known which are also labor intensive and difficult to accomplish.

SUMMARY OF THE PRESENT INVENTION

The present invention provides an improved drive mechanism for automatic paint stirring equipment which overcomes all of the above-mentioned disadvantages of the previously known devices.

In brief, the drive mechanism of the present invention comprises a drive shaft having a diametric cross bore at a position spaced from a first end of the shaft. The shaft also has a diametrically extending opening which extends from the cross bore and to the first end of the shaft. This opening, furthermore, has a smaller cross-sectional area than the cross-sectional area of the cross bore.

The drive shaft is then rotatably mounted to the rack in any conventional fashion so that the first end of the drive shaft is positioned adjacent the driven member of a paint can cover positioned on the rack. A motor is drivingly connected to the other end of the drive shaft to rotatably drive the drive shafts about their axes.

A drive member having an axle and a drive plate is then secured to the first end of the axle. This axle includes a diametrically extending through slot along a portion of its length. The axle is also constructed of a flexible material so that the axle can be readily compressed which diminishes the size of the slot.

The axle and slot are dimensioned such that, upon radial inward compression of the axle causing a reduction in the size of the slot, the axle has a cross-sectional shape smaller than the cross;sectional shape of the shaft opening so that the axle is slidable through the shaft opening and to the shaft cross bore. Once the shaft is positioned in the crossbore, the slot expands in size to its original size such that the axle has a cross-sectional shape greater than the cross-sectional shape of the shaft opening thereby securing the driven member to the drive shaft.

BRIEF DESCRIPTION OF THE DRAWINGS

A better understanding of the present invention will be had upon reference to the following detailed description, when read in conjunction with the accompanying drawing, wherein like reference characters refer to like parts throughout the several views, and in which:

FIG. 1 is a fragmentary perspective view illustrating automatic paint stirring equipment;

FIG. 2 is a front fragmentary view illustrating a preferred embodiment of the invention used for automatic paint stirring equipment;

FIG. 3 is a fragmentary exploded view illustrating the preferred embodiment of the invention;

DETAILED DESCRIPTION OF A PREFERRED EMBODIMENT OF THE PRESENT INVENTION

Figure 4:
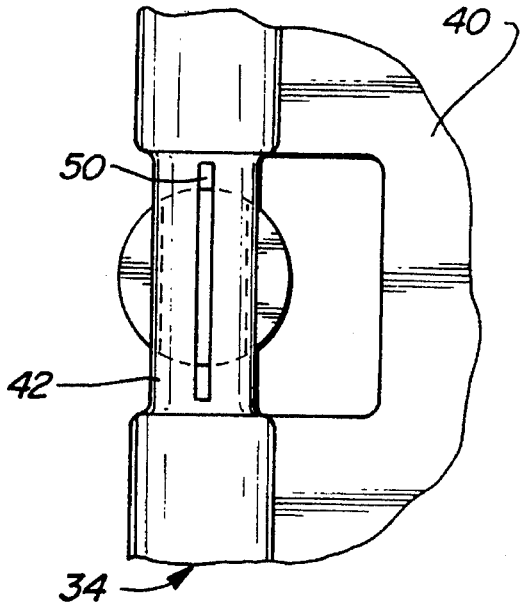
FIG. 4 is a fragmentary view taken substantially along line 4—4 in FIG. 3 and enlarged for clarity.

With reference first to FIGS. 1 and 2, a portion of an automatic paint stirring equipment 10 is thereshown and comprises a rack 12 adapted to removably receive and support a plurality of paint cans 14. As shown in FIG. 1, the rack 12 includes a horizontally extending shelf 16 which supports the paint cans 14 although other systems are also known.

Still referring to FIGS. 1 and 2, a cover 18 is secured across the top of each paint can 14. An elongated shaft 20 is rotatably mounted to each cover 18 and includes a stirring element or paddle 22 which is contained within the interior of the paint can 14. A driven member 24 (FIG. 2) is also secured to the shaft 20 above the paint can cover. As best shown in FIG. 2, this driven member typically comprises a pair of upwardly extending and radially spaced ears 26 so that the driven member 24 is generally U-shaped.

Still referring to FIGS. 1 and 2, a plurality of spaced drive shafts 28 (FIG. 2) are rotatably mounted to the rack 12 by bushings 30 so that the drive shafts 28 extend generally vertically. Furthermore, a lower or first end 32 of each drive shaft 28 is positioned adjacent the driven member 24 of one paint can cover 18 once positioned within the rack 12.

As best shown in FIG. 2, a generally planar and rectangular drive member 34 is secured to the lower end 32 of each drive shaft 28. The drive member 34 is dimensioned so that a portion fits in between the ears 26 of the driven member 24. Consequently, upon rotation of the drive shaft 28, the drive member 34 and driven member 24 rotate in unison with each other. Any conventional means, such as a motor 36 (illustrated only diagrammatically in FIG. 1) and pulley assembly 38 is utilized to drive the shafts 34 with their attached driven members 34.

With reference now to FIG. 3, the drive member 34 is there illustrated in greater detail and comprises a generally rectangular plate 40 having an axle 42 extending along one edge 44. The axle 42 is constructed of a flexible and resilient material, such as plastic. Additionally, in the preferred embodiment, both the axle 42 and drive plate 40 are of a one-piece construction.

Figure 5:
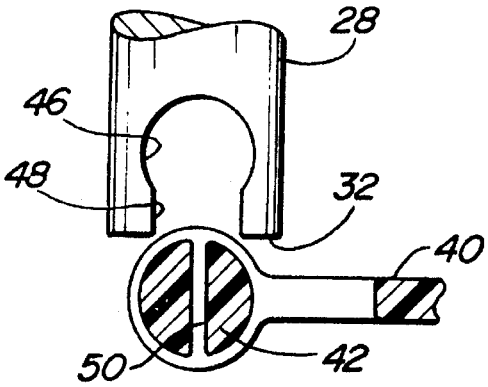
FIGS. 5–8 are all fragmentary diagrammatic views illustrating the operation of the preferred embodiment of the invention.

With reference now to FIG. 5, the lower end 32 of the drive shaft 28 includes a circular cross bore 46 which extends diametrically through the shaft 28. Additionally, a diametrically extending opening 48 connects the cross bore 46 with the lower axial end 32 of the drive shaft 28. Furthermore, the cross-sectional shape or area of the opening 48 is smaller than the cross-sectional shape or opening of the cross-bore 46.

As best shown in FIGS. 4 and 5, the axle 42 includes a diametric through slot 50 extending along its length. Furthermore, the plane of the through slot 50 is preferably substantially perpendicular to the plane of the drive plate 40.

Figure 6:
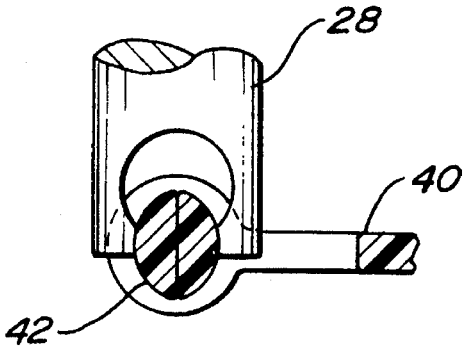
Figure 7:
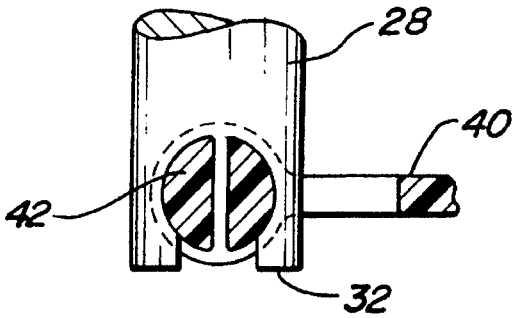

With reference now to FIGS. 5–7, the axle 42 and through slot 50 are dimensioned so that, by pressing the axle 42 into the shaft opening 48 with the slot 50 aligned with the opening 48, the axle 42 compresses radially inwardly as shown in FIG. 6. This inward compression decreases the size of the slot 50 so that the cross-sectional shape or area of the axle 42 is less than the cross-sectional shape or area of the shaft opening 48. This enables the axle 42 to be slid through the shaft opening 48 as shown in FIG. 6 and to the shaft cross bore 46 as shown in FIG. 7.

Figure 8:
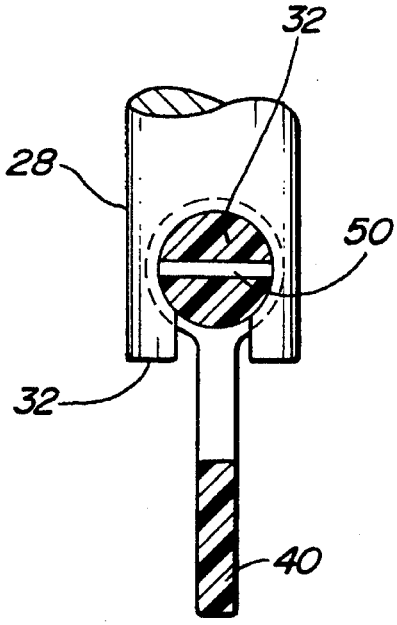

With the axle 42 positioned within the cross bore 46 (FIG. 7) the radial compression on the axle 42 releases so that the axle returns to its original shape which is greater than the cross-sectional shape of the opening 48 and about the same or somewhat smaller than the area of the shaft cross bore 46. Consequently, the release of the radial compression force on the axle 42 (FIG. 7) attaches the axle 42, and thus the drive member 34, to the shaft 28. Subsequent rotation of the plate 40 to the operating position shown in FIG. 8 diametrically aligns the slot 50 with shaft 28 and prevents detachment of the drive member 34 from the shaft 28 in the event that a downward force is applied to the drive member 34.

In practice, the drive member 34 is positioned as shown in FIG. 5 and then simply pressed through the shaft opening 48 and to the shaft cross bore 46. The coaction between the shaft 28 and the sides of the axle 42 cause the axle 42 to radially inwardly compress as shown in FIG. 6 until the axle reaches the cross bore as shown in FIG. 7. This, in turn, provides very simple and rapid assembly of the drive member 44 onto the drive shaft 28.

Having described my invention, many modifications thereto will become apparent to those skilled in the art to which it pertains, without deviation from the spirit of the invention as defined by the scope of the appended claims.

I claim:

1. For use in conjunction with automatic paint stirring equipment of the type having a rack adapted to removably receive and support paint cans, each paint can having a cover, a stirring element contained within the can and a driven member positioned above the cover and mechanically connected to the stirring element, an improved mechanism for rotatably driving the stirring element comprising:

a drive shaft having a diametric cross bore at a position spaced from a first end of said shaft, said shaft having a diametrically extending opening extending from said cross bore to said first end of said shaft, said opening having a smaller cross sectional area than said cross bore, means for rotatably mounting said shaft to the rack so that said first end of said shaft is positioned adjacent the driven member, means for rotatably driving said shaft, a drive member having an axle and a drive plate secured to said axle, said axle having a diametrically extending through slot, wherein said axle and said slot are dimensioned such that, upon radial inward compression of said axle causing a reduction in the size of said slot, said axle has a cross sectional shape smaller than said shaft opening so that said axle is slidable through said shaft opening and to said shaft cross bore, and wherein upon release of said axle causing an expansion in the size of said slot, said axle has a cross sectional shape greater than said shaft opening.

2. The invention as defined in claim 1 wherein said drive plate is planar and generally rectangular in shape, said drive plate having an edge secured to opposite ends of said axle.

3. The invention as defined in claim 2 wherein said axle slot lies in a plane generally perpendicular to a plane of said drive member.

4. The invention as defined in claim 1 wherein said axle is constructed of a flexible material.

5. The invention as defined in claim 4 wherein said axle is constructed of plastic.

6. The invention as defined in claim 1 wherein said shaft cross bore and said axle are circular in cross sectional shape.

7. The invention as defined in claim 1 wherein said axle and said drive plate are of a one piece construction.

* * * * *